US005642086A

United States Patent [19]

Nelson

[11] Patent Number: 5,642,086

[45] Date of Patent: Jun. 24, 1997

[54] MAGNETIC SWITCH FOR COAXIAL TRANSMISSION LINES

[76] Inventor: Victor H. Nelson, 8 Midvale Ct., East Northport, N.Y. 11731

[21] Appl. No.: 519,691

[22] Filed: Aug. 28, 1995

[51] Int. Cl.[6] ..... H01H 53/00

[52] U.S. Cl. ..... 335/4; 335/5; 335/105

[58] Field of Search ..... 335/4, 5, 105, 335/106, 256.8, 261.2; 310/36, 38

[56] References Cited

U.S. PATENT DOCUMENTS 4,633,201 12/1986 Ruff ..... 333/106

4,965,542 10/1990 Nelson ..... 335/4

*Primary Examiner*—Lincoln Donovan

*Attorney, Agent, or Firm*—Charles E. Baxley, Esq.

[57] ABSTRACT

A switch includes switching elements which are mounted within a sealed radio frequency cavity. The switching elements provide electrical contact paths between contact portions of connectors which project into the cavity. The switching elements are urged against the contacts by magnetic forces. During operation, unselected paths have their switching elements grounded out by the action of external magnets which attract the unselected switching elements to a ground plate with a magnetic force which overcomes the magnetic forces urging the switching elements against the contacts.

14 Claims, 8 Drawing Sheets

MAGNETIC SWITCH FOR COAXIAL TRANSMISSION LINES

BACKGROUND OF INVENTION

The present invention relates generally to switches used for coaxial radio frequency transmission lines and more particularly to an improved magnetic switch for use with such transmission lines.

The prior art related to switches for the control of radio frequency and high frequency transmission between signal input and signal output transmission lines have employed various mechanical devices including: spring actuated contacts, plungers, articulated joints and other movable elements to perform the switching action. These devices are subject to numerous deficiencies including: poor reliability, slow response time, lack of latching capability and relatively large insertion losses.

The prior art also includes U.S. Pat. No. 4,965,542 which incorporates a cavity in which one or more conductive contact members are movable from an open position, spaced away from pairs of line terminals, to a closed position, bridging one or more pairs of terminals. The contact members include magnetized strips or non-magnetic strips carrying magnets or magnetic members.

Despite the advances in the state of the art provided by the switches according to U.S. Pat. No. 4,965,542, there still remains a need for a coaxial switch which can accomplish the switching function without resorting to multiple solenoids. As an example, a single pole, triple throw, SP3T switch would typically require three solenoids, one for each position. This results in a switch which is relatively large in size, expensive, cumbersome, inefficient and unreliable.

OBJECTS AND SUMMARY OF INVENTION

It is an object of the present invention to provide a magnetic switch for coaxial transmission lines which is relatively small in size and all switching is performed in a closed cavity.

Another object of the present invention is to provide a magnetic switch for coaxial transmission lines which is capable of reliable operation for extended periods of time.

Another object of the present invention is to provide a magnetic switch for coaxial transmission lines which can perform switching operations between various switch positions in a random or non-sequential manner.

Another object of the present invention is to provide a magnetic switch for coaxial transmission lines which can be configured to provide a range of switch configurations.

Yet another object of the present invention is to provide a magnetic switch for coaxial transmission lines which comprises a relatively small number of component parts resulting in a relatively low overall cost.

The foregoing and other objects and advantages of the present invention will appear more fully hereinafter.

In accordance with the present invention, there is provided a magnetic switch for coaxial transmission lines which includes a radio frequency (RF) sub-assembly and an actuator/indicator sub-assembly. The RF sub-assembly has a housing which includes a fully sealed cavity which is completely sealed against electro-magnetic-interference (EMI) where the switching elements, when selected, move a relatively small distance as part of the switching action under the influence of magnetic attraction or repulsion. Typically, four SMA-type or TNC-type or type N radio frequency connectors are mounted on the housing and project into the cavity. The connectors provide gold-plated fixed radio frequency contacts.

The housing includes four switching paths, each of which is precision machined to produce a 50 ohm line for the switching element. Each path contains one of the four switching elements. The switching elements are preferably made of soft magnetic iron and are gold plated.

Beneath each of the switching elements, and located within the housing of the SMA-type or TNC-type connectors, there is mounted a rare earth magnet that attracts the switching element to its pair of RF contacts. Each of the switching elements includes a pair of dielectric posts such as tetrafluoroethylene (sold by dupont under a trademark TEFLON), or equivalents, which project from the switching element and are slidably mounted in the housing. The RF sub-assembly also includes a top ground plate.

The actuator/indicator sub-assembly includes external attracting magnets which are mounted on a sector motor actuator above the switching elements. During operation, the unselected paths will have their switching elements grounded out by the action of the external magnets which attract the switching elements to the ground plate with a relatively strong magnetic force which overcomes the weaker magnetic force of the rare earth magnets in the RF connector housings.

As a result of the construction of the apparatus of the present invention, a high degree of electrical isolation is achieved by grounding the unselected switching elements with relatively strong magnetic forces in paths that are designed to be well below electrical cut-off frequencies and by locating the switching elements in a sealed RF cavity.

BRIEF DESCRIPTION OF THE DRAWINGS

Other important objects and advantages of the present invention will be apparent from the following detailed description, taken in conjunction with an accompanying drawings in which.

DETAILED DESCRIPTION OF THE INVENTION

Figure 1:
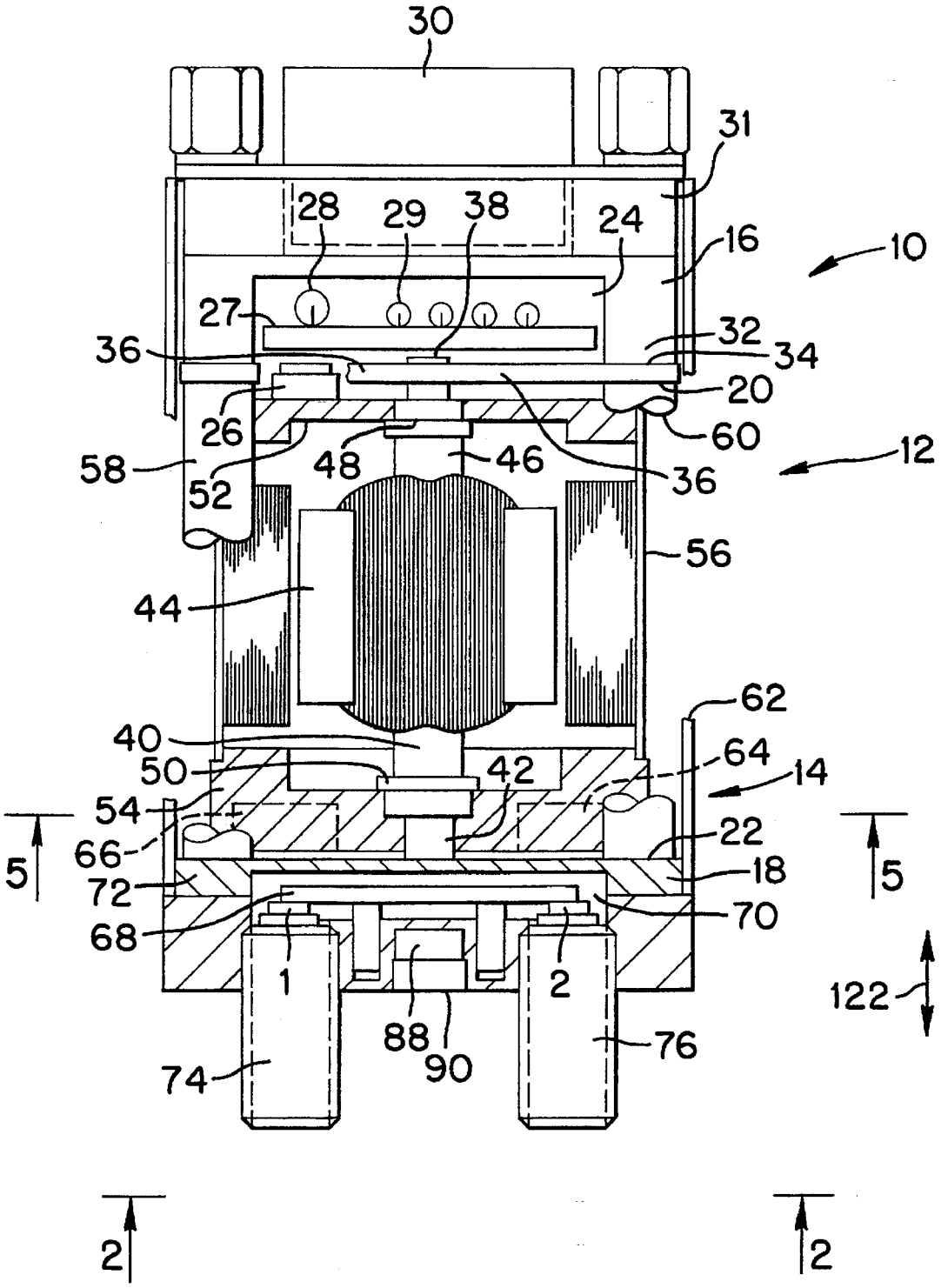
FIG. 1 is a cross-sectional view of a magnetic switch for coaxial transmission lines according to the present invention.

With reference to the drawings, wherein like reference numbers designate like or corresponding parts throughout, there is shown in FIG. 1 a magnetic switch for coaxial transmission lines 10 which includes: an actuator/indicator sub-assembly 12 and a radio frequency (RF) head sub-assembly 14.

The actuator/indicator sub-assembly 12 includes: a top housing 16 and a bottom housing 18 which are connected by support posts 58, 60 which are typically disposed at the surfaces 20, 22 of the top and bottom housings 16, 18. The top housing 16 includes a cavity 24 within which there is mounted a reed magnet 26 and a printed circuit board 27 on which a reed switch 28 and a plurality of diodes 29 are mounted. Reed switch 28 and reed magnet 26 shown in FIG. 1 are typical of up to three similarly symmetrically mounted reed switches, one reed switch for each actuation position. A power connector 30 is mounted on an upper portion 31 of the top housing 16. Conventional power terminals, which are not shown, may be used in lieu of the power conductor 30. Lower portion 32 of the top housing 16 includes a support plate 34, the central portion 36 of which supports the upper end 38 of a shaft 40.

Lower end 42 of the shaft 40 is supported by the bottom housing 18. A stationary armature 44 is mounted on central portion 46 of shaft 40.

An upper bearing 48 is mounted on shaft 40 proximate to top housing 16 and a lower bearing 50 is mounted on shaft 40 proximate to bottom housing 18. The upper bearing 48 supports an upper retainer 52 and lower bearing 50 supports a lower retainer 54. The upper and lower retainers 52, 54 are connected by a magnet housing 56 which is capable of rotation relative to the stationary armature 44 in the order of 90 degrees in a manner which will be presently described. Top and bottom housings 16, 18 are joined by the support posts 58, 60 and by a cover 62.

Figure 2:
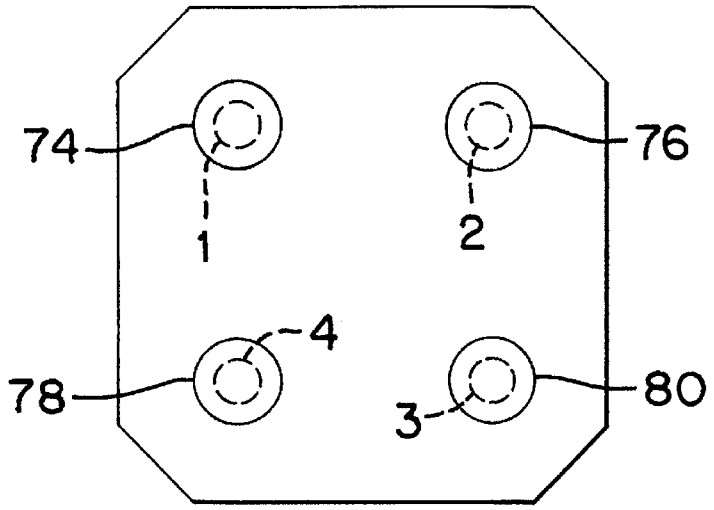
FIG. 2 is a bottom view of the switch of FIG. 1 taken along line 2—2 in FIG. 1.
Figure 10A:
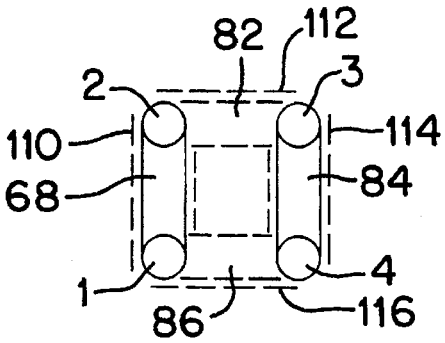
FIGS. 10A and 10B are schematic diagrams of the switch elements of the switch shown in FIG. 1, with the switch configured as a double-pole-double-throw type of switch.

Bottom housing 18 includes magnets 64, 66 which, during operation of switch 10 are used to attract and ground out selected switching elements 68 which are located in a sealed radio frequency cavity 70 which is located in a lower portion 72 of bottom housing 18. The contacts 1, 2, 3, 4 of the four SMA-type connectors 74, 76, 78, 80, shown in FIG. 2, project into the radio frequency cavity 70. The bottom housing 18 typically includes four switch elements 68, 82, 84, 86 which are shown in FIG. 10A.

In the various schematic drawings, FIGS. 8A, 8B through 12A, 12B and 12C, the switch elements which have been activated and which are thus in contact with the various contacts 1, 2, 3, 4 are shown in solid lines while the switch elements which are inactive and which have been grounded are shown in broken lines. The connector contacts of the connectors 74, 76, 78, 80 are indicated typically by reference numbers 1, 2, 3, 4. In FIGS. 13A, 13B and 13C, the contacts are indicated by reference numbers 1, 2, 3, 4, 5 and the inactive switch elements have not been shown for purposes of clarity of illustration. The activation of the various switch elements will be described presently.

Figure 3:
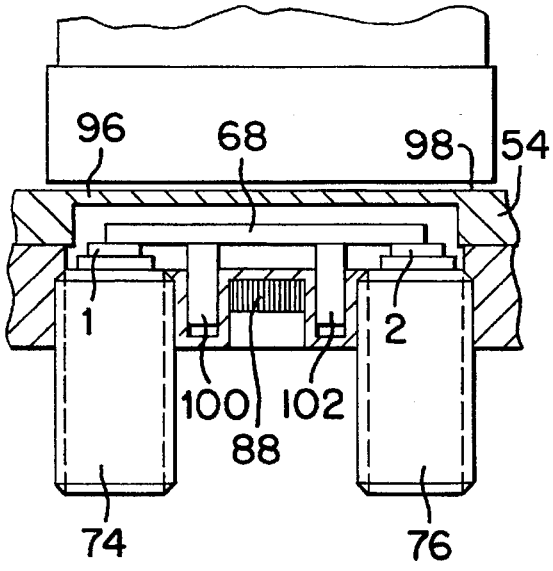
FIG. 3 is a fragmentary cross-sectional view, similar to FIG. 1, showing a switch element contacting a pair of radio-frequency connectors.
Figure 4:
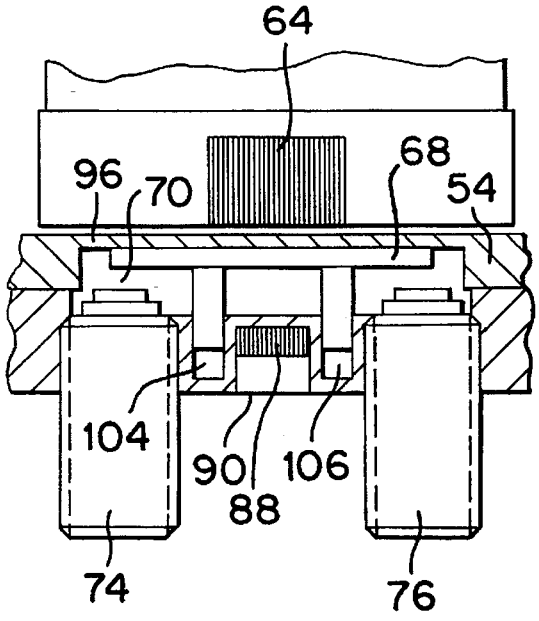
FIG. 4 is a fragmentary cross-sectional view similar to FIG. 2, but showing the switch element in contact with the ground plane.

As is shown in FIGS. 1, 3 and 4, a bottom magnet 88 which is mounted in the lower portion 90 of the bottom housing 18 attracts the switching element 68 to the contacts 1, 2 of the SMA-type connectors 74, 76, thereby completing a radio frequency circuit between the two SMA-type connectors 74, 76.

Figure 5:
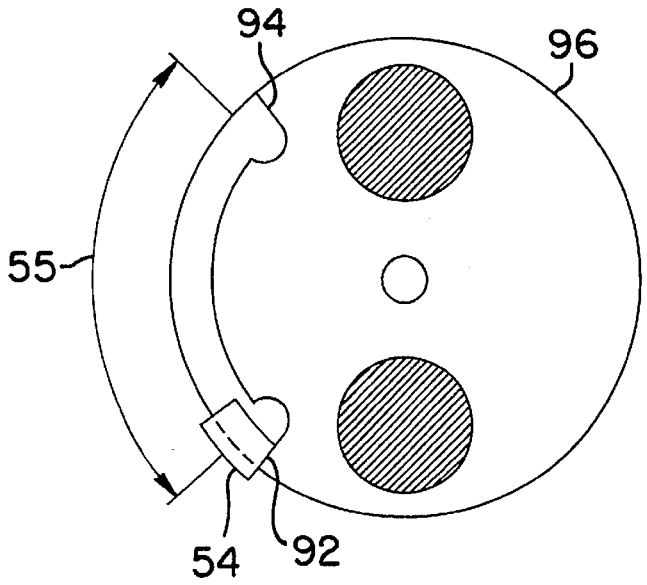
FIG. 5 is a cross-sectional view taken along line 5—5 of FIG. 1.

As is shown in FIG. 5, the bottom retainer 54 is capable of rotation in the order of 90 degrees as indicated by the arrows 55 and the rotational travel of bottom retainer 54 is limited by stops 92, 94, which are formed in ground plate 96, which forms the upper portion 98 of the radio frequency cavity 70.

FIG. 4 shows how rotation of the bottom retainer 54 into the position shown has brought upper magnet 64 into alignment with switch element 68. As is shown in FIG. 4, the upper magnet 64 has overcome the attractive force of the lower magnet 88 and has lifted the switch element 68 away from the contacts 1, 2 and has brought the switch element 68 into contact with the ground plate 96.

The switch elements 68, 78, 80, 82 are preferably made of soft magnetic iron. The magnetic force exerted by the upper magnet 64 is preferably in the order of 4 oz. while the magnetic force exerted by the bottom magnet 88 is in the order of 1 oz. so that the upper magnet 64 easily and reliably overcomes the force of the bottom magnet 88 when the upper magnet 64 is moved into alignment with the switch element 68. The bottom magnet 88 is preferably a rare earth magnet.

The switch element 68 has a pair of projecting posts 100, 102 which are slidably mounted in holes 104, 106 formed in the bottom housing 18. The posts 100, 102 are preferably made of Teflon or Kel-F and have a preferred diameter in the order of 0.062 inches.

As is shown in FIG. 10A, each of the switch elements 68, 82, 84, 86 is mountedly guided within a precision-machined path or slot 110, 112, 114, 116, 118 in the housing 18. The paths 110, 112, 114, 116, 118 are proportioned to provide a 50 ohm line for the switching elements 68, 82, 84, 86. The vertical motion in the direction shown by the arrow 122 in FIG. 1 is in the order of 0.040 inches, which may be varied dependent on requirements.

During operation, when a command is received via the connector 30, the actuator 12 will rotate clockwise or counterclockwise to the desired position which is defined by stops 92, 94 as is shown in FIG. 5. The selected switching element will come under the influence of the bottom magnets 88 to be forced into contact with the contacts 1, 2, 3, 4 to complete the circuit. The unselected switch elements will be attracted by the top magnets 64, 66 on the actuator 12 and will be forced against the ground plate 96.

A unique mechanical advantage is achieved by the switch 10 according to the present invention in that the actuator 12 does not require additional prime power to produce increased contact force since all the actuator 12 has to do is position the strong top magnets 64, 66 over switch elements 68, 82, 84, 86 to produce the switching action. The contact force is thus solely dependent on the magnetic forces.

In addition, the switch 10 according to the present invention: provides a strong and predictable contact force, uses a simple highly reliable mechanism which does not rely on plungers, springs or friction; uses a relatively limited and controlled movement of the switching elements 68, 82, 84, 86. The movement of the switching elements 68, 82, 84, 86 within a defined slot 110, 112, 114, 116 which is formed inside a sealed radio-frequency (RF) cavity 70 results in unsurpassed RF performance as measured by Voltage Standing Wave Ratio (VSWR) and loss performance.

If the upper magnets 66 and 68 are made to attract the lower magnets 88, a self-detenting action occurs. If magnets 66, 68 are reversed, a self-repelling action occurs. If upper magnet 66 attracts and upper magnet 68 repels, the assembly provides no interaction other than moving the switching elements. The RF sub-assembly 14 which includes the RF cavity 70 and the connectors 74, 76, 78, 80, forms a modular sub-assembly which facilitates testing at the sub-assembly level prior to assembly with the next assembly.

The reed magnet 26 and the reed switch 28 enable the actuator/indicator assembly 12 to provide a signal which indicates the rotational position which has been attained by the magnet housing 56 thereby providing a feedback signal.

Figure 10B:
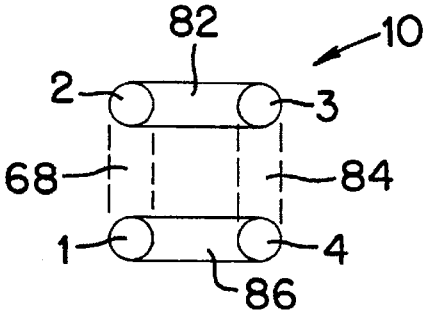

FIGS. 10A and 10B show a schematic diagram of the switch 10 of FIG. 1. As shown in FIG. 10A, switch elements 68, 84 shown in solid lines, have been selected. Switch element 68 is attracted to contacts 1, 2 and provides a connection between contacts 3, 2 and switch element 84 is attracted to the contacts 3, 4 and provides a connection between contacts 3, 4.

Switch elements 82, 86, shown in broken lines, have been attracted by magnets 64, 66 and have been grounded by contact with ground plane or ground plate 96.

In FIG. 10B, in position number two, switch elements 82, 86, shown in solid lines, have been attracted to contacts 2, 3 and 1, 4 while switch elements 68, 84, shown in broken lines, have been attracted to the ground plane 96. The switch 10 as shown in FIGS. 10A and 10B thus functions as a double-pole-double-throw switch.

Figure 9A:
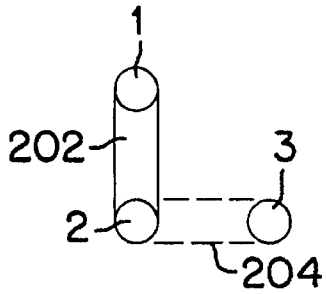
FIGS. 9A and 9B schematic diagrams of the switch elements of the switch shown in FIG. 1 with the switch configured as a single-pole-double-throw type of switch.
Figure 9B:
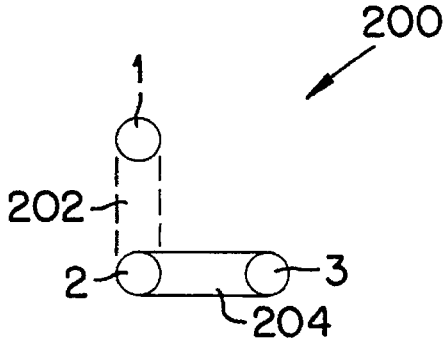

FIGS. 9A and 9B show the schematic diagram of an alternative embodiment 200 of the switch 10 of FIG. 1, which functions as a single-pole-double-throw switch and which generally incorporates the same structure as FIG. 1 with the exception that three connectors and three contacts 1, 2, 3 and two switch elements 202, 204 are utilized.

Following the same general convention as described in connection with FIGS. 10A and 10B, in FIG. 9A, in position number one, contacts 1 and 2 are connected by switch element 202 while in FIG. 9B, in position number two, contacts 2, 3 are connected by switch element 204.

Another alternative embodiment of the present invention 300 is shown in FIGS. 6, 7, 7A, 8A, 8B and 8C. As previously described, in connection with FIG. 1, the sector motor armature 302 in the actuator assembly 303 remains stationary. Sector motor 304 contains four electromagnetic poles that will react to a rotary permanent magnet field.

Armature 302 which is hard-wired, in the order of 60–300 ohms per pole (depending on available voltage), and per RF position, will receive switching commands producing a magnetic pole action which will repel the adjacent stator permanent magnet 306 thereby producing sufficient torque to rotate stator 308 to the selected position. Magnet housing assembly 310 is supported by a shaft 311 and bearings 312, 314 in a manner similar to that which has been previously described.

Stator 308 is maintained in the end positions against a pair of hard stops 309 by magnetic forces in the sector motor 304 and by attractive forces in the RF head sub-assembly 316, which will be presently described. Stops 309 in the switch 300 are similar to stops 92, 94 which have been described in connection with FIG. 5. Reed magnets 319 and reed switches 321 are similar to like items 26, 28 in FIG. 1 and provide a feedback signal.

Figure 7:
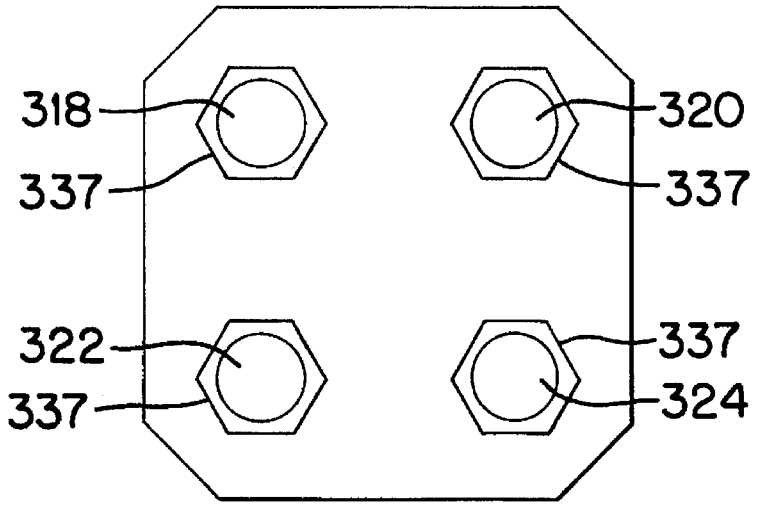
FIG. 7 is a bottom view of the switch of FIG. 6, taken along line 7—7 in FIG. 6.
Figure 7A:
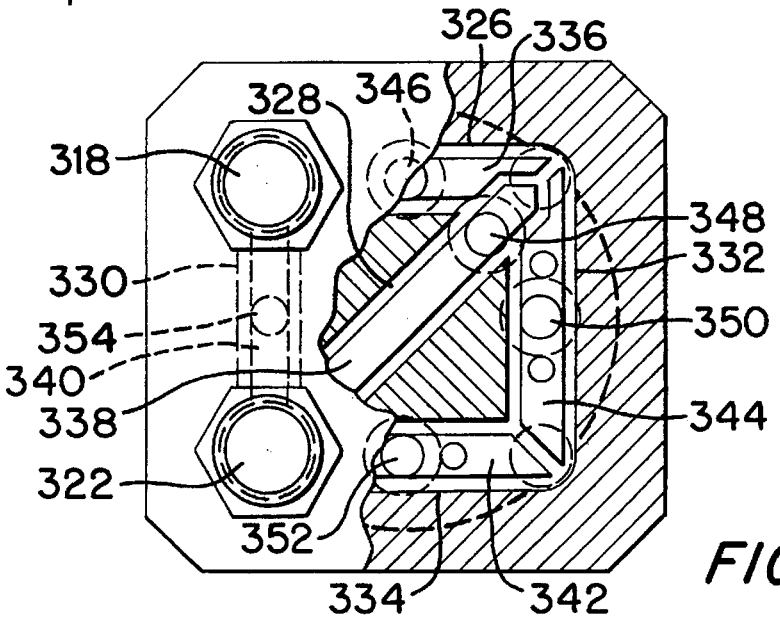
FIG. 7A is a bottom view of the switch of FIG. 6, similar to FIG. 7, with a portion shown broken away to reveal details of the internal construction of the RF cavity.
Figure 8A:
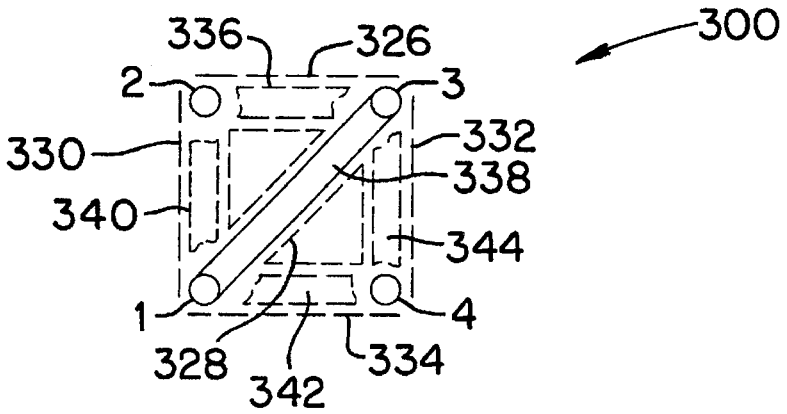
FIGS. 8A, 8B and 8C are schematic diagrams of the various positions of the switch elements of the embodiment of FIG. 6.

As is shown in FIGS. 7, 7A and 8A, switch 300 includes four connectors 318, 320, 322, 324 and five switching paths 326, 328, 330, 332, 334. The connectors 318, 320, 322, 324 are assembled and held in place by hexnuts 335.

Figure 6:
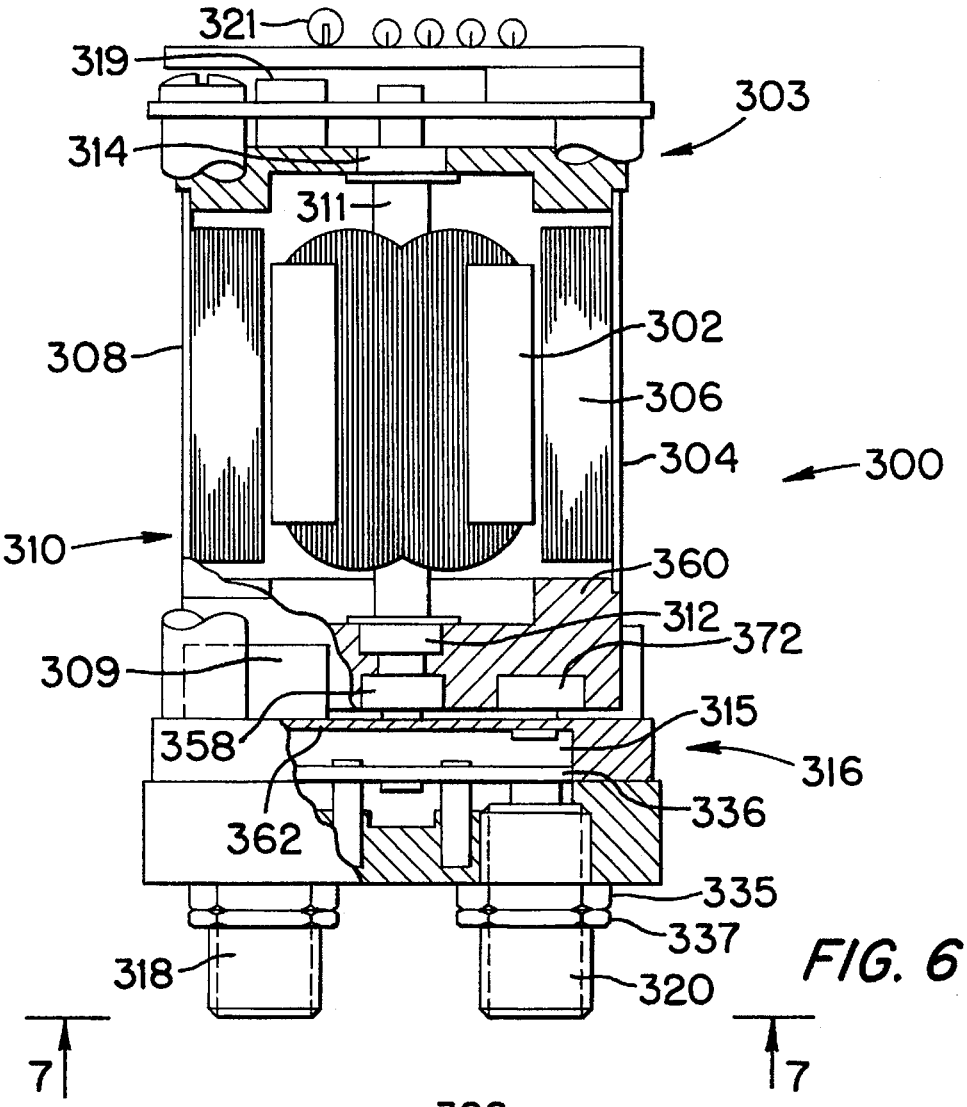
FIG. 6 is a cross-sectional view of an alternative embodiment of the switch of FIG. 1.

The five switching paths 326, 328, 330, 332, 334 within the cavity 315 in RF head 316 are precision-machined to produce a 50 ohm line for the switching elements 336, 338, 340, 342, 344. In contrast to the switching elements 68, 82, 84, 86 previously described, the switching elements 336, 338, 340, 342 are made of half-hard brass which has been gold plated. A magnet 346, 348, 350, 352, 354 is attached to each switching element 336, 338, 340, 342, 344 as is best shown in FIGS. 6 and 7A. Switch element magnets 346, 348, 350, 352, 354 are preferably rare earth type magnets and are typically in the order of 2 mm in diameter by 1 mm in height.

Switch element magnets 346, 348, 350, 352, 354 react to actuating magnets 356, 358 which are mounted on the rotating housing 360 in a manner which will be presently described. The size and spacing of the actuating magnets 356, 358 and the switch element magnets 346, 348, 350, 352, 354 is such that, when selected, switch elements are repelled by the actuating magnets 356, 358 and are thereby maintained in contact with the contacts 1, 2, 3, 4 by a force which is in the order of one ounce.

The sealed RF head 316 contains a top ground plate 362, the five switch elements 336, 338, 340, 342, 344 and the contacts 1, 2, 3, 4 of the SMA type or TNC connectors 318, 320, 322, 324.

Figure 8B:
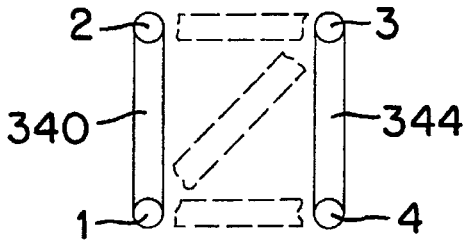
Figure 8C:
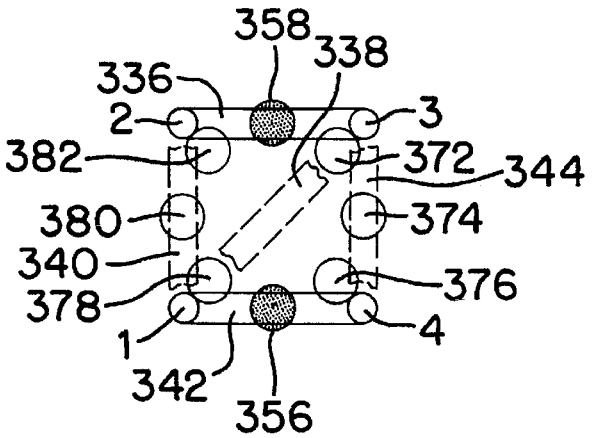

As is best shown in FIGS. 7A and 8C, during operation, the selected switch elements 336, 342 are maintained by external repelling magnets 356, 358 and the unselected paths will have their switch elements 338, 340, 344 grounded out by external attracting magnets 372, 374, 376, 378, 380, 382. The external attracting magnets 372, 374, 376, 378, 380, 382 are mounted on the rotating housing 360 above the switch elements 336, 338, 340, 342, 344.

As previously described, the attracting magnets 372, 374, 376, 378, 380, 382 provide a force which is in the order of four ounces. High isolation is thus achieved by the combination of the following: grounding unselected switch elements with the above described, relatively strong, four ounce force; operation of the switch elements 336, 338, 340, 342, 344 within precision machined paths 326, 328, 330, 332, 334 which are proportioned to be well below cutoff frequencies; and location of the switch elements 336, 338, 340, 342, 344 and the machined switching paths 326, 328, 330, 332, 334 within the sealed RF cavity 315.

The switch 300 according to the present invention is capable of accomplishing a random switching sequence wherein a switch 300 may be switched to any of the switching paths 326, 328, 330, 332, 334 regardless of sequence. When a command is received, the actuator 303 will rotate clockwise or counterclockwise 45 or 90 degrees to the desired position wherein adjacent positions are separated by 45 degrees and the end positions are separated by 90 degrees. Selected switch elements will come under the influence of repelling magnets 356, 358 to be forced against the selected contacts to complete the circuit. The unselected switch elements will be attracted by the external attracting magnets 372, 374, 376, 378, 380, 382 and will be forced against the ground plane 362.

FIGS. 7A and 8C show the location of the repelling 356, 358 and attracting 372, 374, 376, 378, 380, 382 magnets.

The contacts have been designated by reference numbers 1, 2, 3, 4. In FIG. 8C, attracting magnets 372, 374, 376, 378, 380, 382 have been shown as open circles and the repelling magnets 356, 358 have been shown as shaded circles. As is shown in FIG. 8C, switch element 336 is in alignment with repelling magnet 358 and switch element 342 is in alignment with repelling magnet 356. The switch element 336 establishes contact between the contacts 2 and 3 while switch element 342 establishes contact between contacts 1 and 4.

Switch elements 338, 344, 380, shown in broken lines, have not been selected and these switch elements are urged against the ground plane 362 by attracting magnets 372, 374, 376, 378, 380, 382.

FIG. 8A shows contact established between contacts 1 and 3 by switch element 338.

FIG. 8B shows contact established between contacts 1 and 2 by the switch element 340 and contact established between contacts 3 and 4 by switch element 344.

Figure 11A:
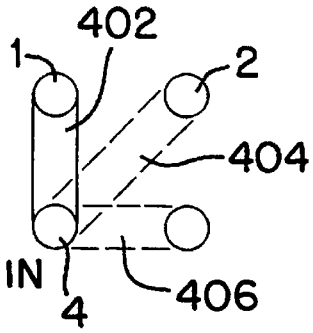
FIGS. 11A, 11B and 11C are schematic diagrams of the switch elements of the switch shown in FIG. 1 with the switch configured as a single-pole-triple-throw type of switch.
Figure 11B:
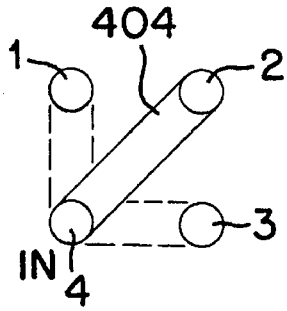
Figure 11C:
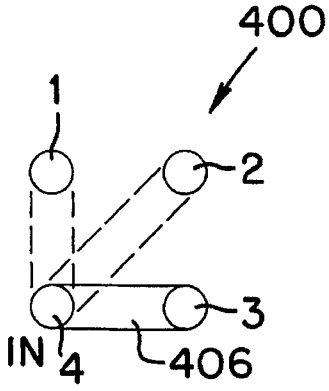

FIGS. 11A, 11B and 11C show the schematic diagram of an alternative embodiment 400 of the invention, which functions as a single-pole-triple-throw switch and which generally incorporates the same structure as FIG. 1. In FIG. 11A, the contact 4 which functions as the input and contact 1 are connected by switch element 402. In FIG. 11B, the contacts 4 and 2 are connected by the switch element 404 and in FIG. 11C the contacts 4 and 3 are connected by the switch element 406. In FIG. 11A, the unselected switch elements 404, 406 have been shown in broken lines.

Figure 12C:
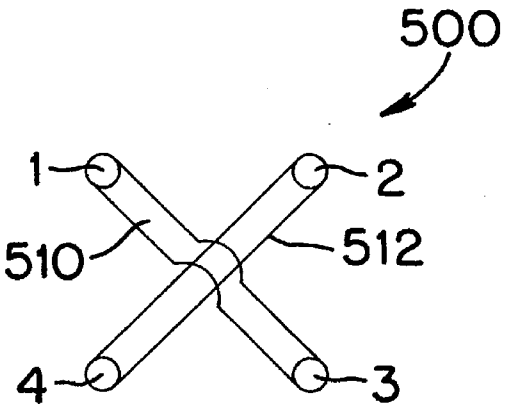
FIGS. 12A, 12B and 12C are schematic diagrams of the switch elements of the switch shown in FIG. 1 with the switch configured as a T-type of switch.
Figure 12B:
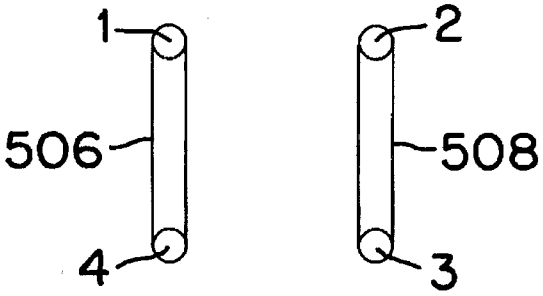
Figure 12A:
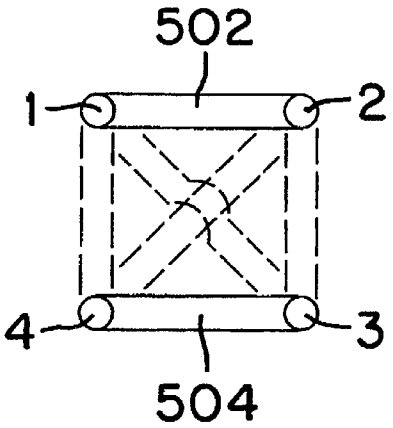
Figures 13A, 13B, 13C:
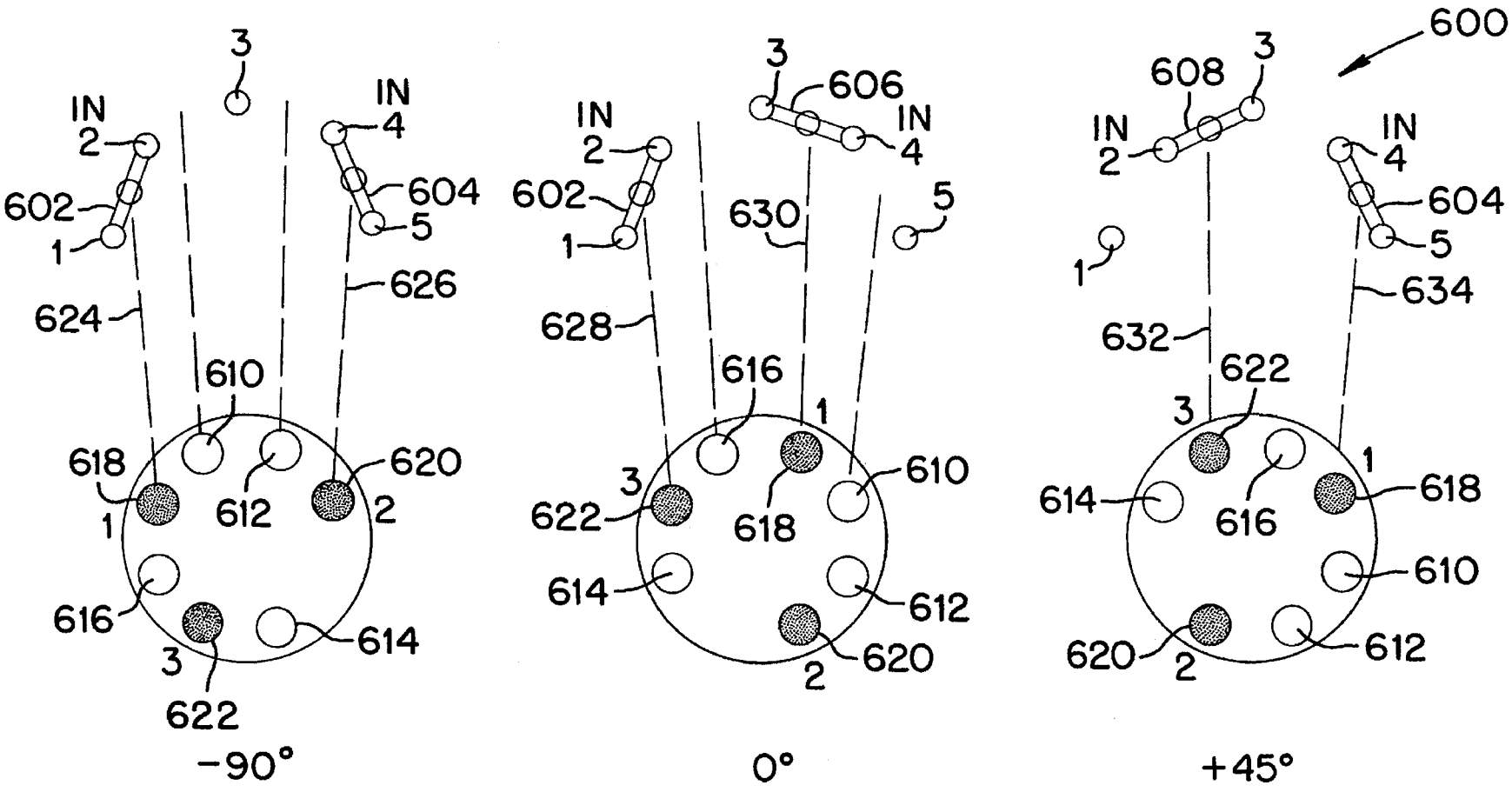
FIGS. 13A, 13B and 13C are schematic diagrams of the switch elements of the switch shown in FIG. 5, with the switch configured as a double-pole-triple-throw type of switch.

FIGS. 12A, 12B and 12C show the schematic diagram of an alternative embodiment of the invention 500 which functions as a "T" type of a switch and which generally incorporates the same structure as FIG. 1. In FIG. 12A, contacts 1 and 2 are connected by switch element 502 and contacts 3 and 4 are connected by switch element 504. In FIG. 12B, contacts 3 and 4 are connected by switch element 506 and contacts 2, 3 are connected by switch element 508. In FIG. 12C, contacts 1, 3 are connected by switch element 510 and contacts 2, 4 are connected by switch elements 512. As is shown in FIG. 12C, the switch element 510 bridges over and does not contact the switch element 512.

FIGS. 13A, 13B and 13C show the schematic diagram of another alternative embodiment of the invention 600 which functions as a double-pole-triple-throw switch and which incorporates a total of five contacts 1, 2, 3, 4, 5 with contacts 2 and 4 functioning as the input contacts. FIGS. 13A, 13B and 13C also show, in schematic form, the location of the various switching elements 602, 604, 606, 608 and attracting magnets 610, 612, 614, 616 and repelling magnets 618, 620, 622 of the switch 600. Switch 600 has the same general construction as has been shown and described in connection with FIG. 6. The attracting magnets 610, 612, 614, 616 have been illustrated as open circles while the repelling magnets 618, 620, 622 have been illustrated as shaded circles. The attracting magnets attract the unselected switching elements to a ground plate 362 in the manner which has been previously described.

In FIG. 13A, the rotating housing 310 has rotated to a position defined as a minus 90 degrees (−90°) position and the repelling magnets 618, 620 have forced the switch element 602 to make contact between the contacts 1 and 2 and have forced the switch element 604 to make contact between the contacts 4 and 5, as indicated by the broken lines 624, 626 which indicate the alignment of the repelling magnets 618, 620 with the switch elements 602, 604.

In FIG. 13B, the rotating housing 310 has rotated to a position defined as a zero degree (0°) position and the repelling magnets 622, 618 have forced the switch element 602 to make contact between the contacts 1 and 2 and have forced the switch element 606 to make contact between the contacts 3 and 4, as indicated by the broken lines 628, 630.

In FIG. 13C, the rotating housing 360 has rotated to a position defined as plus 45 degrees (+45°) position and the repelling magnets 622, 618 have forced the switch element 608 to make contact between the contacts 2 and 3 and have forced the switch element 604 to make contact between the contacts 4 and 5 as indicated by the broken lines 632, 634.

The switch 600 thus provides a double-pole-triple-throw switch which uses only a single actuator, thereby achieving a significant simplification both in mechanical structure and wiring and an improvement in reliability over the prior art.

The foregoing specific embodiments of the present invention, as set forth in the specification, are for illustrative purposes only. Various changes and modifications may be made within the spirit and scope of this invention.

I claim:

1. A magnetic switch for coaxial transmission lines comprising:

hollow housing means defining a closed cavity;

at least two connectors each having contact members with said connectors mounted on said housing and with said contact members projecting into said closed cavity;

switch element means slideably mounted in said closed cavity;

first magnet means mounted on said housing and disposed to urge said switch element means into contact with said contact members;

rotatable actuator means mounted on said housing;

ground plane means disposed in said hollow housing;

second magnet means mounted on said actuator means and movable with rotation of said rotatable actuator means, with said second magnet means capable of urging said switch elements means away from said contact members and capable of urging said switch element means against said ground plane means.

2. The magnetic switch for coaxial transmission lines as claimed in claim 1, in which said switch element means is made of a magnetic material.

3. The magnetic switch for coaxial transmission lines as claimed in claim 1, further comprising slot means formed in said closed cavity with said switch element means disposed in said slot means.

4. The magnetic switch for coaxial transmission lines as claimed in claim 3, further comprising guide means disposed on said switching element means for guiding said switching element means within said slot means.

5. The magnetic switch for coaxial transmission lines as claimed in claim 4, in which said guide means comprises non-conductive projecting post means.

6. The magnetic switch for coaxial transmission lines as claimed in claim 1, in which said actuator means comprises magnetic actuator means.

7. The magnetic switch for coaxial transmission lines as claimed in claim 1, in which said actuator means further comprises position sensor means.

8. The magnetic switch for coaxial transmission lines as claimed in claim 1, in which said first magnetic means is disposed to attract said switch element toward said contact members.

9. The magnetic switch for coaxial transmission lines as claimed in to claim 1, in which said second magnetic means is disposed to attract said switch element toward said ground plane means.

10. The magnetic switch for coaxial transmission lines as claimed in claim 1, in which said switch element is made of a non-magnetic material and further comprising a magnet mounted on said switch element.

11. The magnetic switch for coaxial transmission lines as claimed in claim 10, in which said first magnetic means is mounted on said actuator means and in which said first magnetic means is disposed to repel said switch element away from said ground plane means and toward said contact members.

12. The magnetic switch for coaxial transmission lines as claimed in claim 1, further comprising stop means mounted on said housing for control of the motion of said actuator means.

13. The magnetic switch for coaxial transmission lines as claimed in claim 1, wherein polarity of the first magnet means and the second magnet means are selected to provide for self detenting or self repelling in addition to actuating or deactuating the switch element means.

14. The magnetic switch for coaxial transmission lines as claimed in claim 1, wherein polarity of the first magnet means and the second magnet means are selected to provide for no magnetic interdiction in addition to actuating or deactuating the switch element means.

* * * * *